US007731054B1

(12) United States Patent
Lassota

(10) Patent No.: US 7,731,054 B1
(45) Date of Patent: Jun. 8, 2010

(54) BEVERAGE URN WITH HANDLE ASSEMBLY

(75) Inventor: Zbigniew G. Lassota, Long Grove, IL (US)

(73) Assignee: Food Equipment Technologies Company, Inc., Lake Zurich, IL (US)

( * ) Notice: Subject to any disclaimer, the term of this patent is extended or adjusted under 35 U.S.C. 154(b) by 1279 days.

(21) Appl. No.: 11/134,482

(22) Filed: May 20, 2005

Related U.S. Application Data

(60) Provisional application No. 60/573,181, filed on May 21, 2004.

(51) Int. Cl.
*B65D 25/28* (2006.01)
*B65D 53/02* (2006.01)

(52) U.S. Cl. ..... 220/769; 222/475.1

(58) Field of Classification Search ..... 220/699, 220/700, 768, 769, 796, 802; 222/475, 475.1
See application file for complete search history.

(56) References Cited

U.S. PATENT DOCUMENTS 3,268,106 A * 8/1966 Satz ..... 220/789
4,090,648 A * 5/1978 Roberts ..... 222/475.1
5,379,925 A * 1/1995 Mothrath et al. ..... 222/475.1
7,163,131 B2 * 1/2007 Becker ..... 222/570

* cited by examiner

*Primary Examiner*—Anthony Stashick
*Assistant Examiner*—Harry A Grosso
(74) *Attorney, Agent, or Firm*—James W. Potthast; Potthast & Associates

(57) ABSTRACT

A beverage urn (10) with a thin-walled glass body (12) having a flat bottom (14), a cylindrical containment section (16) and a cylindrical neck (22) with a circular top edge (24) surrounding a top opening (26) and an outwardly downwardly body section (18) extending from the bottom of the neck (22) to the top of the cylindrical containment section (16). Attached to the outwardly extending body section (18) and overlying the top opening (26) is a handle assembly (28) with an L-shaped handle (40) carried by a mounting body (30) that protectively overlies the circular top edge (24) and surrounds the cylindrical neck (22) in protective spaced relationship. The handle assembly (28) is secured to the outwardly extending body section (18) by means of a mating set of ratchet gear teeth (52,54) respectively carried by mating connection portions of an internal mounting ring (44) and the mounting body (30). The internal mounting ring (44) is preferably made of resilient, moldable plastic that is installed into the interior of the glass body (12) in the mounting position (FIG. 3) by distorting the outwardly extending, frustoconical mounting section (46) of mounting ring (44) as needed to push it though top opening (26) of the glass body (12).

30 Claims, 3 Drawing Sheets

BEVERAGE URN WITH HANDLE ASSEMBLY

CROSS REFERENCE TO RELATED APPLICATIONS

This application claims, under 35 USC 119(e), the benefit of provisional patent application Ser. No. 60/573,181, filed May 21, 2004.

BACKGROUND OF THE INVENTION

1. Field of the Invention

This invention relates generally to beverage urns and, more particularly, to beverage urns with handles for manual lifting and pouring of beverage from an open top of the urn.

2. Discussion of the Prior Art

Beverage urns, carafes, or decanters, of the type that have a thin-walled hollow containment body with an open top at the end of a relatively narrower neck connecting the open top to the containment body are well known. Typically, they are made of borosilicate glass or the like and are capable of holding approximately twelve cups of beverage. Such earns are often used with so-called "one pot brewers" in which coffee or other hot beverage is brewed directly into the urn when in a brew position. The urn generally rests on an electrical warmer plate to maintain the temperature of the beverage within the containment body. The urn may have a spout integrally formed in the neck. A handle assembly is mechanically attached to the neck by means of a band, or attachment ring, surrounding the neck and a handle attached to and extending vertically downwardly from the ring alongside the containment body. If there is no spout integrally formed in the neck, then the handle assembly also includes a spout that is formed in the ring and located oppositely of the handle. When it is desired to serve the beverage the urn is lifted by the handle and tilted to pour beverage from the spout into an individual serving cup.

Examples of such known beverage urns are shown in U.S. Pat. Nos. 5,224,634 issued Jul. 6, 1993 to Graham; 2,982,451 issued May 2, 1961 to Eisendrath; 3,154,227 issued Oct. 27, 1964 to Anderson et al.; 3,330,449 issued Jul. 11, 1967 to Bloomfield et al.; 3,400,865 issued Sep. 10, 1968 to Hester; 3,491,924 issued Jan. 27, 1970; 3,615,045 issued Oct. 26, 1971 to Fiorini; 3,632,025 issued Jan. 4, 1972 to Bloomfield et al.; 3,800,9988 issued Jun. 17, 1968 issued to Karlen et al. and 4,090,648 issued Apr. 9, 1976 to Roberts, all of which are hereby incorporated by reference.

In all of these urns, the attachment ring directly contacts and engages the outer side of the neck for direct attachment to the neck. The neck is provided with horizontal ribs with which associated connectors of the attachment ring mate in interlocking relationship to prevent vertical removal of the ring from the neck. Also, generally, there is a bead formed at the top edge of the neck that is slightly wider than the neck, and this bead is directly contacted and engaged by mating connectors associated with the attachment ring, generally on the inside of the bead to provide a blocking bearing surface to further assist in blocking vertical removal of the ring from the neck.

The inventor has noted that it is not uncommon for the neck of such urns to break or crack adjacent the juncture of the attachment band with the neck. It is believed that such breakage is due to stress and strain on the neck and bead due to being tightly engaged by the attachment band while being required to support the entire weight of the urn and the beverage while being tilted.

SUMMARY OF THE INVENTION

It is therefore the object of the present invention to provide handle assembly for an urn, a beverage urn of the type noted above with the handle assembly that reduces the forces applied to the neck during assembly and during pouring of the beverage to reduce the risk of breakage of the neck.

This objective is achieved in part by provision of a beverage urn assembly having a hollow, relatively thin-walled body with a bottom, an open top defined by a surrounding top edge of the body and an outwardly extending body section located relatively near the top edge, spaced from the bottom and extending radially outwardly of the surrounding top edge and a handle assembly including an external mounting member with a handle and an outwardly extending attachment section located adjacent to and above and exterior surface of the outwardly extending body section, and an internal mounting ring located within the hollow body and having an outwardly extending mounting section located adjacent to and beneath an interior surface of the outwardly extending body section, a locking mechanism for locking the outwardly extending attachment section to the outwardly extending mounting section with only the outwardly extending body section being engaged by and squeezed between the outwardly extending attachment section and the outwardly extending mounting section.

In the preferred embodiment both of the outwardly extending attachment section and the outwardly extending mounting section are spaced from the top edge. Also, the hollow body has a neck extending upwardly between the outwardly extending attachment section and the top edge and both the outwardly extending attachment section and the outwardly extending mounting section are spaced from the neck to reduce any stress or strain being applied to the neck. For like reasons, if a bead is present, the attachment section and the mounting section are both spaced from the bead.

Also, preferably, the locking mechanism is located above the top edge and is in the form of interlocking mating connectors that become interlocked when the attachment section is pushed down over the top edge, such as two sets of matching ratchet gears.

BRIEF DESCRIPTION OF THE DRAWINGS

The foregoing objects and advantageous features of the present invention will be described in detail and others will be made apparent from the detailed description below that is given with reference to the several figures of the drawing, in which.

DETAILED DESCRIPTION

Figure 1:
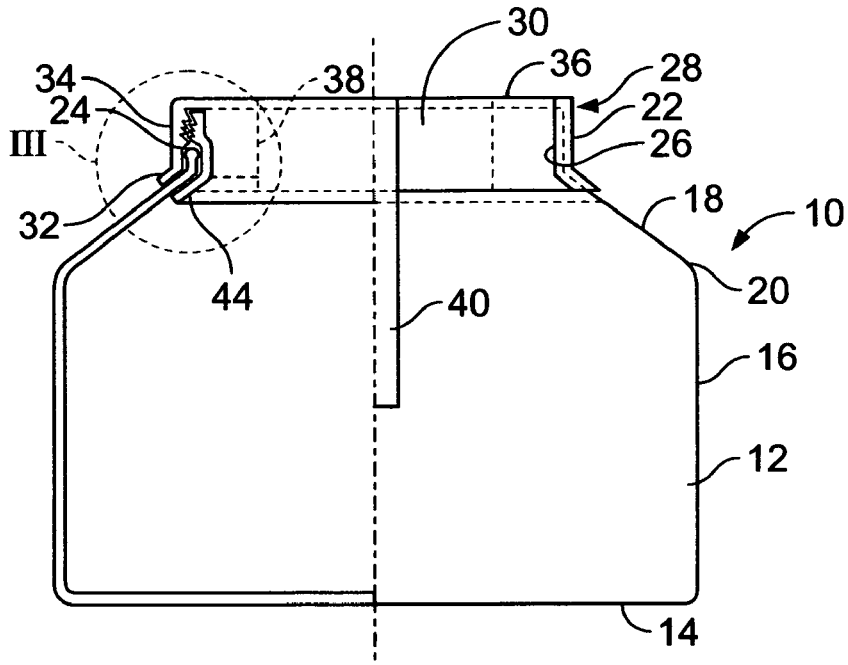
FIG. 1 is a side elevation view of the beverage urn of the present invention with half shown in cross section.
Figure 2:
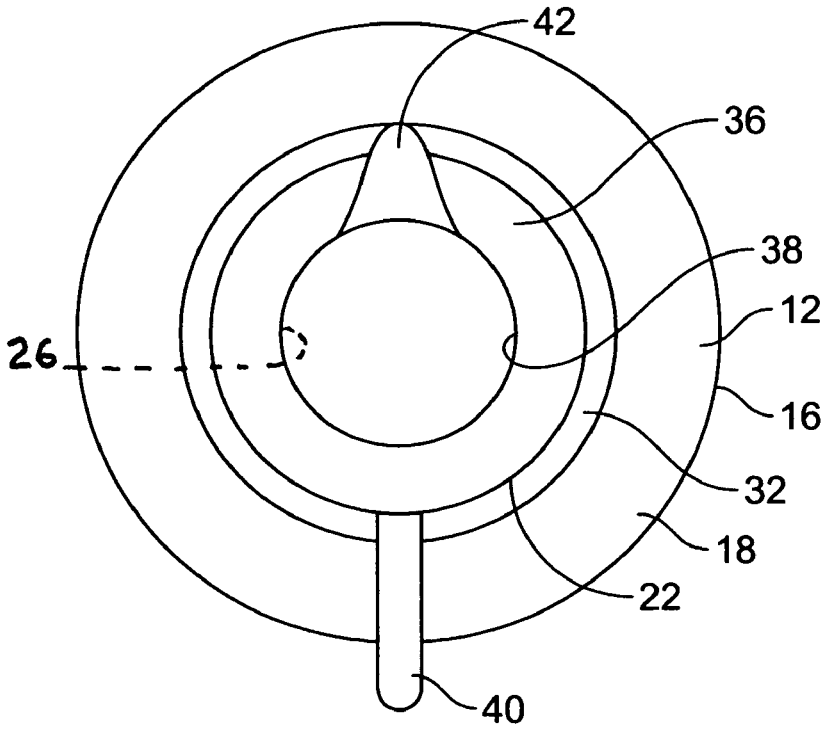
FIG. 2 is a plan view of the beverage urn of FIG. 1.
Figure 3:
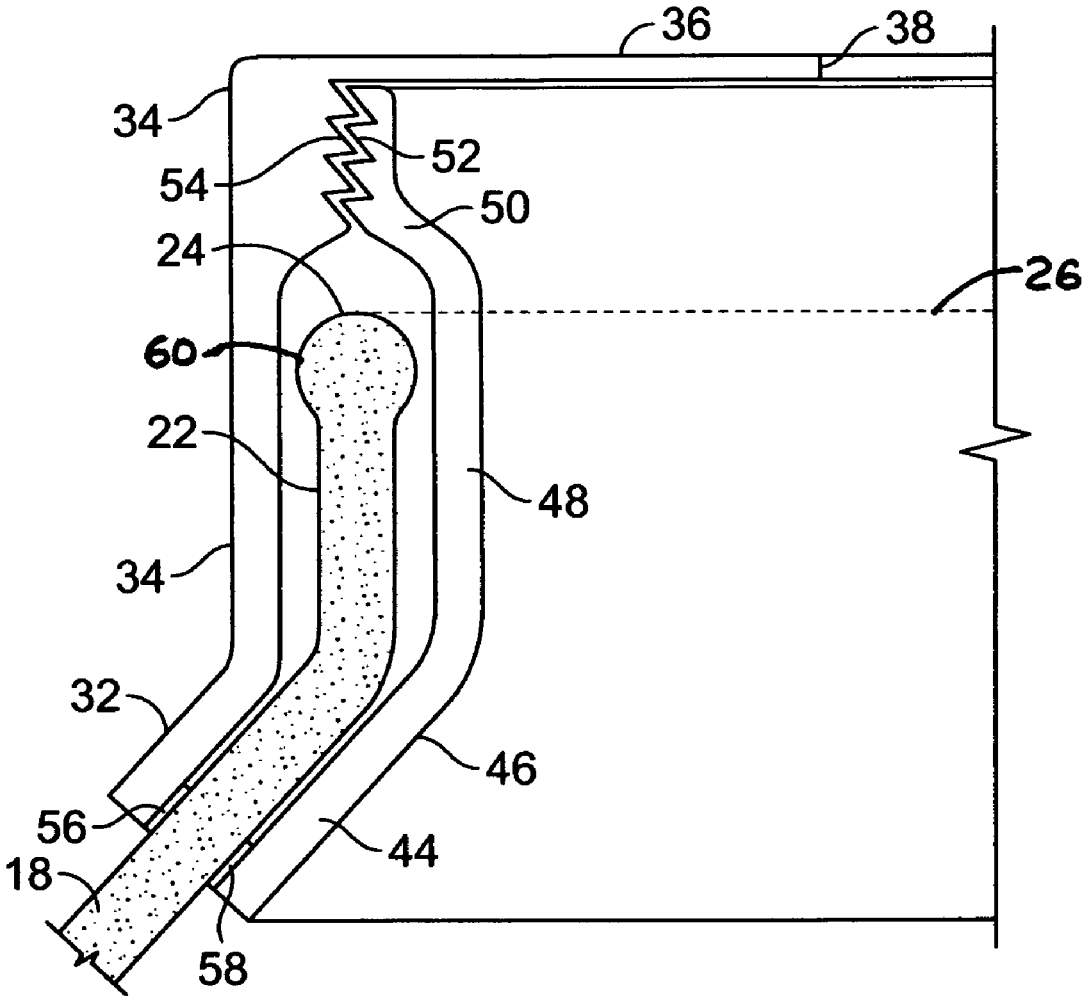
FIG. 3 is an enlarged sectional side view a portion of the beverage urn of FIGS. 1 and 2 that has been marked by the Roman numeral III.

Referring to FIGS. 1, 2 and 3, the beverage urn 10 of the present invention has a transparent, hollow, body 12 made of borosilicate glass or the like that is capable of withstanding the rigors of thermal expansion and contraction without cracking. The beverage urn is generally used for receipt of hot water, hot coffee or the like and may also be kept in contact with electric heating plates to maintain the temperature of the beverage within the urn. The glass body 12 has a flat bottom 14, a cylindrical or other circular cross-sectional shaped side section, or containment body, 16 and a frustoconical, outwardly extending, upper body section 18 joined to the side section 16 by a shoulder 20. The upper end of the upper outwardly extending body section 18 is joined to an upwardly extending cylindrical neck 22 with a circular top edge 24 surrounding a top opening 26. The outwardly extending section 18 extends outwardly of the top edge and preferably also extends downwardly from the juncture with the neck. Alternatively, the section 18 extends horizontally laterally, although some downward extent is preferred.

Attached to the outwardly extending, upper body section 18 and overlying the top opening 26 is a handle assembly 28 with a mounting body 30 of circular cross-section that is mounted to the top of the glass body 12 and overlies the top circular edge 24. The bottom of the mounting body 30 has an outwardly extending, preferably frustoconical, attachment section 32 joined at its top to a cylindrical wall 34. The cylindrical wall 34, in turn, is joined at its upper end to a flat, annular top 36 with an access opening 38.

The mounting body 30 carries a generally L-shaped handle 40 that extends radially outwardly from the cylindrical wall 34 and downwardly toward the bottom 14. Preferably, on the side of the access opening 38 directly opposite from the handle 40 is a spout 42 radially extending outwardly from side of the opening 38.

Preferably, all the composite elements of the handle assembly 28 are integrally formed from a suitable moldable plastic approved for use with hot beverages. As will be explained with reference to FIGS. 3 and 4, the handle assembly 28 is mounted to the glass body 12 by means of a fastening relationship with an internal mounting ring 44 in which the outwardly extending body section 18 of the glass body 12 is squeezed between the outwardly extending attachment section of mounting body 30 and an outwardly extending mounting section 46 the internal mounting ring 44.

Referring now to FIG. 3, it is seen that the internal mounting ring 44 has in addition to the outwardly extending, frustoconical, bottom mounting section 46, an intermediate cylindrical section 48 and an outwardly extending upper connection portion 50. An outwardly facing surface of the upper connection portion 50 has a set of outwardly extending ratchet gear teeth 52. The interior surface of a mating connection portion of the cylindrical wall 34 has a set of inwardly extending ratchet gear teeth 54 that are adapted to mate and interlock with the ratchet gear teeth 52 against upward movement. The internal mounting ring 44 is sufficiently resiliently flexible to be cammed inwardly by the leading edge of the mounting body 30 until all the gears mesh and the resilient mounting ring snaps back into the position shown in the drawings. The internal mounting ring 44 may be held in place by a suitable tool or may be supported against the top edge 24 during the relatively vertical connection motion.

The internal mounting ring 44 is preferably made of resilient, moldable plastic that is suitable for use with hot beverages. The mounting ring 44 is installed into the interior of the glass body 12 in the mounting position shown in FIG. 3 by distorting the frustoconical section 46 of mounting ring 44 as needed to push it though top opening 26 of the glass body 12. An outwardly radially extending shoulder of the upper section 50 extending between the intermediated cylindrical section 48 and the outwardly facing ratchet gear teeth 52 overlies the top circular edge 24 to block passage of the upper section 50 beneath the top edge 24 and into the hollow body 12.

When installed in the mounting position, as shown in FIG. 3, the frustoconical bottom section 46 of the mounting ring 44, which extends outwardly and downwardly, at the same angle as that of the body section 18 and is located adjacent the interior surface of the frustoconical section 18 of the glass body 12. The intermediate section 48 is located adjacent the interior surface of the cylindrical neck 22 of the glass body 12. The teeth 52 of the upper section 50 of the interior mounting ring 44 extend above the end 24 of the cylindrical section of the glass body 12.

When the handle and spout assembly 28 is laid over the open top of the glass body 12 and pushed downwardly over the open top of the glass body 12, the ratchet gears 54 engage and mesh with the ratchet gears 52. The assembly is continued to be pressed down until the gears 52 and 54 are full intermeshed and locked into full attachment position, as shown in FIG. 3. In the full attachment position, the cylindrical wall is located adjacent the cylindrical neck 22 of the glass body 12, and the frustoconical section is located adjacent the frustoconical bottom section 46 of the mounting ring 44.

Resilient, water tight, relatively heat impervious, annular seals 56 and 58 that are suitable for use with hot beverages respectively seal the ends of the frustoconical sections 32 and 44 to the exterior and interior surface of the frustoconical section 18 of the glass body 12. The seals 58 and 56 are painted or otherwise adhered affixed to either the glass surface of the glass body in the location shown or may be first affixed to the ends of the mounting ring section 46 and the mounting member section 32. Such seal material is routinely used on the interior of screw-on jar lids, such a pickle jars.

In the full attachment position, the intermeshed ratchet teeth 52 and 54 prevent separation of the mounting member 30 from the mounting ring 44, while the overlying relationship of the inwardly tapered frustoconical section 18 of the glass body 12 relative to the inwardly tapered section 46 of the mounting ring 44 blocks removal of the mounting ring from out of the glass body 12. Since the mounting ring 44 is locked to the mounting member 30 and the internal mounting member 44 is secured to the downwardly outwardly extending body section 18, the handle assembly 28 is fully secured to the glass body 12 without any stress or strain being applied to the neck 22.

As seen, there is a gap between the relatively fragile neck portion 22 and the top edge 24, on the one hand, and the internal mounting member, or mounting ring, 44 and the external attachment member 30, on the other hand. By avoiding attachment to or connection with the neck 22, the risk of damage to the cylindrical neck 22 and the top edge 24 are significantly reduced. Instead of attachment to the neck as in known beverage urn hand and spout assemblies, the handle and spout assembly 28 of the present invention is secured beneath the neck 22 where the frustoconical section 18 of the body is squeezed between the interior mounting ring 44 and the mounting member 30. Because the section 18 has a horizontal component, when the urn 10 is lifted by the handle and spout assembly 28, an upward bearing force is imposed against interior surface of the section 18 by the exterior surface of the frustoconical section 46 of the mounting ring 44. This provision of bearing support and engagement eliminates the need to rely solely upon frictional engagement of the section 18 being squeezed between the frustoconical section 32 of the mounting body 30 and the frustoconical section 46 of the internal mounting ring 30.

Advantageously, this avoidance of attaching the mounting body 30 to the cylindrical neck and the stresses that would be imposed upon the neck enables provision of a relatively larger diameter for access opening 38 than would otherwise be achieved, such as three and one half inches, which is generally large enough to allow a persons hand to pass for hand cleaning of the interior surface of the glass body.

Figure 4:
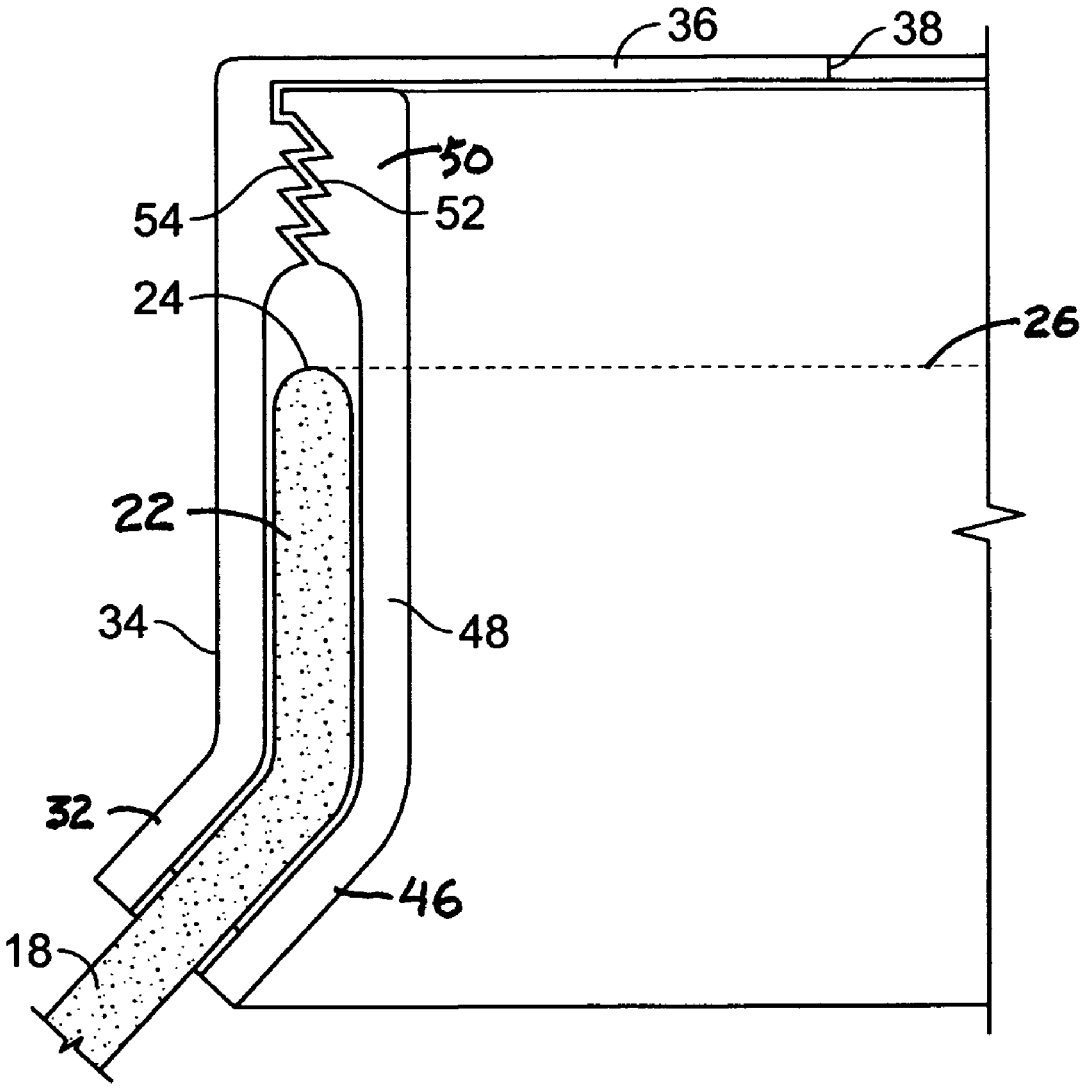
FIG. 4 is an enlarged sectional side view of a portion of another form of the beverage urn of FIGS. 1-2 that is similar to that of FIG. 3.

Referring to FIG. 4, a modified form of the invention is shown in which the top edge 24 is not provided with a reinforcing bead 60, FIG. 3, which has a diameter larger than the width of the neck 22. In the present invention, since the assembly is mounted or attached to the portions of the body 12 beneath the neck 22, and not to the neck 22, itself, and sealing is not performed in association with the neck 22, there is no need for such a reinforcement bead 60 and the bead 60 may be eliminated. In such case, as shown in FIG. 4, the interior sides of the mounting ring 44 and the mounting body 30 may be located closer to the sides of the neck 22, if desired, but still without contacting either the sides of the neck 22 or the top edge 24

While a particular form of the invention has been disclosed in detail, the scope of the invention is not necessarily limited to such details. Conceptually, the most distinguishing features are believed to include the sandwich-type attachment of the assembly to the glass body beneath the neck using an interior locking member, the use of simple cylindrical seals on both the inside and the outside of the glass body, the use of painted-on or other pre-adhered seals, the fixed interlocking of the assembly to the interior mounting ring simply by pushing the assembly down onto the open top of the glass body 12 and the ability to provide a relatively larger access opening to enable hand cleaning of the interior. While the ratchet gears are preferred, other means for providing a one way interlock akin to the intermeshing ratchet gears may also be used, such as interlocking pins and pinholes, hooks and mating eyelets, etc. Instead, of multiple ratchet gear teeth, a single tooth might suffice. Alternatively, the connection portions could be secured together by other means such as by heat fusing them together, by use of adhesive or by means of elongate fasteners. Also, while the frustoconical shapes are preferred for use as the outwardly extending body section to which the handle and spout assembly is attached to avoid deep corners that are more difficult to clean and to facilitate insertion of the internal mounting ring, it should be appreciated that the outwardly extending body section and both of the outwardly extending mounting sections could be arranged horizontally to form a right angle with the cylindrical neck. While the internal mounting ring is preferably installed into the interior of the glass body simply by distorting it and pushing it though the top opening, it is also contemplated that it could be installed with a split that is reconnected after insertion or is made of two separate parts that are joined together after insertion. Other obvious variations from the preferred embodiment exist and reference to claims should be made to determine the scope of the invention.

The invention claimed is:

1. A beverage urn assembly, comprising:

a hollow, relatively thin-walled body with a bottom, an open top defined by a surrounding top edge of the body and an outwardly extending body section located relatively near the top edge spaced from the bottom and extending outwardly of the surrounding top edge;

a handle assembly including an external mounting member with a handle and an outwardly extending attachment section located adjacent to and above an exterior surface of the outwardly extending body section, and an internal mounting ring located within the hollow body and having an outwardly extending mounting section located adjacent to and beneath an interior surface of the outwardly extending body section, and a locking mechanism for locking the outwardly extending attachment section to the outwardly extending mounting section with only the outwardly extending body section being engaged by and squeezed between the outwardly extending attachment section and the outwardly extending mounting section.

2. The beverage urn of claim 1 in which both of the outwardly extending attachment section and the outwardly extending mounting section are spaced from the top edge.

3. The beverage urn of claim 2 in which the hollow body has a neck extending upwardly between the outwardly extending body section and the top edge, and the external mounting member has an external wall extending between the locking mechanism and the outwardly extending attachment section, the internal mounting ring has an internal wall extending between the locking mechanism and the outwardly extending mounting section, and the neck is located between but entirely spaced from both the internal wall and the external wall when the outwardly extending attachment section is attached to the outwardly extending mounting section by the locking mechanism.

4. The beverage urn of claim 3 in which the locking mechanism is located above the top edge.

5. The beverage urn of claim 1 in which the hollow body has a neck extending upwardly between the outwardly extending attachment section and the top edge, and both the outwardly extending attachment section and the outwardly extending mounting section are spaced from the entire neck.

6. The beverage urn of claim 5 in which the locking mechanism is located above the neck.

7. The beverage urn of claim 1 in which the hollow body has a neck extending upwardly between the outwardly extending body section and the top edge, and the external mounting member has an intermediate section extending between a top of the external mounting member and the outwardly extending section that surrounds but does not engage the neck.

8. The beverage urn of claim 7 in which the neck is substantially cylindrical.

9. The beverage urn of claim 7 in which the internal mounting ring has an intermediate section extending between a top of the internal mounting ring and the outwardly extending mounting section that surrounds but does not engage the neck.

10. The beverage urn of claim 9 in which the neck is cylindrical.

11. The beverage urn of claim 1 in which the hollow body has a neck extending upwardly between the outwardly extending body section and the top edge, and the internal mounting ring has an intermediate section extending between a top of the internal mounting ring and the outwardly extending mounting that surrounds but does not engage the neck.

12. The beverage urn of claim 11 in which the neck is cylindrical.

13. The beverage urn of claim 1 including a seal between the outwardly extending body section and the outwardly extending attachment section.

14. The beverage urn of claim 13 including a seal between the outwardly extending body section and the outwardly extending mounting section.

15. The beverage urn of claim 1 including a seal between the outwardly extending body section and the outwardly extending mounting section.

16. The beverage urn of claim 15 in which the seal is adhered to the outwardly extending body section.

17. The beverage urn of claim 15 in which the seal is painted to the outwardly extending body section.

18. The beverage urn of claim 15 in which the seal is a resilient plastic squeezed between the outwardly extending body section and the outwardly extending mounting section.

19. The beverage urn of claim 1 in which the outwardly extending body section, the outwardly extending attachment section and the outwardly extending mounting section all extend outwardly and downwardly at angles that are approximately the same.

20. The beverage urn of claim 1 in which the top edge of the body is a bead at the top of a thin wall defining a neck extending upwardly from the outwardly extending body section that is wider than the thin wall of the neck.

21. The beverage urn of claim 1 in which the top edge of the body is the top edge of a thin wall defining a neck extending upwardly from the outwardly extending body section and having a width that is approximately the same width as the thin wall of the neck.

22. A beverage urn assembly comprising:

a hollow, relatively thin-walled body with a bottom, an open top defined by a surrounding top edge of the body and an outwardly extending body section located relatively near the top edge, and spaced from the bottom and extending outwardly of the surrounding top edge and an intermediate body section extending between the top edge and the outwardly extending body section a handle assembly including an external mounting member with a top, a handle and an outwardly extending attachment section, and an internal mounting ring located within the hollow body and having an outwardly extending mounting section, and a locking mechanism for locking the outwardly extending attachment section to the outwardly extending mounting section with the outwardly extending body section squeezed between the outwardly extending attachment section and the outwardly extending mounting section, the locking mechanism including an interlocking member located between the top of the external mounting member and the intermediate section in a position above the top edge.

23. A beverage urn assembly, comprising:

a hollow, relatively thin-walled body with a bottom, an open top defined by a surrounding top edge of the body and an outwardly extending body section located relatively near the top edge and spaced from the bottom and extending outwardly of the surrounding top edge, a neck extending upwardly between the outwardly extending body section and the top edge, a handle assembly including an external mounting member with a handle and an outwardly extending attachment section, the external mounting member having an intermediate section extending between a top of the external mounting member and the outwardly extending section that surrounds but does not engage the neck, and an internal mounting ring located within the hollow body and having an outwardly extending mounting section, said internal mounting ring having an intermediate section extending between a top of the internal mounting ring and the outwardly extending mounting that surrounds but does not engage the neck, a locking mechanism for locking the outwardly extending attachment section to the outwardly extending mounting section with the outwardly extending body section squeezed between the outwardly extending attachment section and the outwardly extending mounting section, the locking mechanism including an interlocking member located between the top of the internal mounting ring and the intermediate section in a position above the top edge.

24. A beverage urn assembly, comprising:

a hollow, relatively thin-walled body with a bottom, an open top defined by a surrounding top edge of the body an outwardly extending body section located relatively near the top edge and spaced from the bottom and extending outwardly of the surrounding top edge and a neck extending upwardly between the outwardly extending body section and the top edge;

a handle assembly including an external mounting member with a handle and an outwardly extending attachment section, and an internal mounting ring located within the hollow body and having an outwardly extending mounting section, the internal mounting ring having an intermediate section extending between a top of the internal mounting ring and the outwardly extending mounting section, that surrounds but does not engage the neck, a locking mechanism for locking the outwardly extending attachment section to the outwardly extending mounting section with the outwardly extending body section squeezed between the outwardly extending attachment section and the outwardly extending mounting section, said locking mechanism including an interlocking member located between the top of the internal mounting ring and the intermediate section in a position above the top edge.

25. A beverage urn assembly, comprising:

a hollow, relatively thin-walled body with a bottom, an open top defined by a surrounding top edge of the body and an outwardly extending body section located relatively near the top edge and spaced from the bottom and extending outwardly of the surrounding top edge;

a handle assembly including an external mounting member with a handle and an outwardly extending attachment section, and an internal mounting ring located within the hollow body and having an outwardly extending mounting section, a locking mechanism for locking the outwardly extending attachment section to the outwardly extending mounting section with the outwardly extending body section squeezed between the outwardly extending attachment section and the outwardly extending mounting section, said locking mechanism including a pair of interlocking members respectively carried by the external mounting member and the internal mounting member.

26. The beverage urn of claim 25 in which the locking mechanism includes a plurality of interlocking members.

27. The beverage urn of claim 25 in which the pair of interlocking members faces horizontally and is interlocked during relative vertical movement of the internal mounting member and the internal mounting ring.

28. The beverage urn of claim 25 in which the pair of interlocking members is a pair of interlocking ratchet gear teeth.

29. The beverage urn of claim 25 in which the pair of interlocking members is part of a pair of sets of a plurality of interlocking ratchet teeth.

30. The beverage urn of claim 25 in which the pair of interlocking members is located above and spaced from the top edge.

* * * * *